US008616679B2

(12) United States Patent
Sakurai

(10) Patent No.: US 8,616,679 B2
(45) Date of Patent: Dec. 31, 2013

(54) INKJET PRINTER

(75) Inventor: Hisaki Sakurai, Aichi-ken (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 162 days.

(21) Appl. No.: 12/286,402

(22) Filed: Sep. 30, 2008

(65) Prior Publication Data

US 2009/0085965 A1 Apr. 2, 2009

(30) Foreign Application Priority Data

Oct. 1, 2007 (JP) ..... 2007-257461

(51) Int. Cl.
*B41J 2/165* (2006.01)

(52) U.S. Cl.
USPC ..... 347/35

(58) Field of Classification Search
None
See application file for complete search history.

(56) References Cited

U.S. PATENT DOCUMENTS

| | | | | |
|---|---|---|---|---|
| 6,017,109 | A * | 1/2000 | Saijo | 347/30 |
| 6,709,088 | B2 | 3/2004 | Hayakawa et al. | |
| 6,805,427 | B2 * | 10/2004 | Hosono | 347/31 |
| 6,910,757 | B2 * | 6/2005 | Kanamitsu et al. | 347/31 |
| 6,991,314 | B2 | 1/2006 | Hayakawa et al. | |
| 2004/0051755 | A1 | 3/2004 | Kanamitsu et al. | |
| 2005/0062794 | A1 | 3/2005 | Kanamitsu et al. | |
| 2006/0017770 | A1 * | 1/2006 | Harada et al. | 347/36 |
| 2007/0046722 | A1 | 3/2007 | Komatsu | |

FOREIGN PATENT DOCUMENTS

| | | |
|---|---|---|
| JP | 2001-301201 | 10/2001 |
| JP | 2002-086757 | 3/2002 |
| JP | 2002-086760 | 3/2002 |
| JP | 2002-103706 | 4/2002 |
| JP | 2003-285433 | 10/2003 |
| JP | 2004-009700 | 1/2004 |
| JP | 2004-230806 | 8/2004 |
| JP | 2007-055059 | 3/2007 |

* cited by examiner

*Primary Examiner* — Matthew Luu
*Assistant Examiner* — Alejandro Valencia
(74) *Attorney, Agent, or Firm* — Frommer Lawrence & Haug LLP

(57) ABSTRACT

An inkjet printer is provided. The inkjet printer includes: an inkjet head which ejects ink toward a surface of a recording medium; a platen provided opposed to the inkjet head to support the recording medium from an opposite side of the inkjet head; and an absorber provided opposed to the inkjet head at the same side as the platen with respect to the recording medium supported by the platen. The absorber includes a plurality of regions different in absorption rate from one another in a plan view observed from a normal direction of the recording medium supported by the platen.

11 Claims, 6 Drawing Sheets

INKJET PRINTER

CROSS-REFERENCE TO RELATED APPLICATION

This application claims priority from Japanese Patent Application No. 2007-257461, filed on Oct. 1, 2007, the entire subject matter of which is incorporated herein by reference.

TECHNICAL FIELD

Aspects of the present invention relate to an inkjet printer.

BACKGROUND

An inkjet printer performs borderless printing for forming an image on the entire surface of a sheet as a recording medium without leaving a margin on the peripheral edge part thereof (for example, JP-A-2007-55059). In borderless printing, in order to eject ink drops without leaving a margin on the peripheral edge part of a sheet, ink drops are also ejected in excess to the outside of the peripheral edge part of the sheet. Accordingly, for reducing or preventing the ink drops ejected to the outside of the sheet staining the back surface of the sheet and the like, there is provided an ink absorber in a platen that supports the sheet. Thus, the ink drops ejected to the outside of the sheet directly land on the ink absorber to be absorbed inside thereof.

Meanwhile, for a user who has a preference for photographic printing, there are many opportunities to perform borderless printing, and thus the amount of ink to land on the ink absorber is large. Therefore, from this point of view, it is advantageous that the ink absorber has a higher absorption rate (opening ratio). However, the ink retaining force weakens as the absorption rate of the ink absorber is increased, so that there is a possibility that the ink leaked out therefrom may stain the interior of a printer housing.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to improve ink absorbing ability while maintaining ink retaining ability of an ink absorber as much as possible.

According to an exemplary embodiment of the present invention, there is provided an inkjet printer including: an inkjet head which ejects ink toward a surface of a recording medium; a platen provided opposed to the inkjet head to support the recording medium from an opposite side of the inkjet head; and an absorber provided opposed to the inkjet head at the same side as the platen with respect to the recording medium supported by the platen. The absorber includes a plurality of regions different in absorption rate from one another in a plan view observed from a normal direction of the recording medium supported by the platen.

According to another exemplary embodiment of the present invention, there is provided an inkjet printer including: a platen which supports a recording medium; an inkjet head which ejects ink on the recording medium supported by the platen; and an absorber which is provided at lower position from the inkjet head with respect to a top of the platen and which absorbs the ink ejected from the inkjet head, the absorber including a plurality of regions having different ink absorption capability in a plan view observed from an ink ejecting direction of the inkjet head.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Hereinafter, exemplary embodiments according to the present invention will be described with reference to the drawings. In the following description, the direction in which ink is ejected from an inkjet head is assumed to be downward, and the opposite direction thereof is assumed to be upward.

(First Exemplary Embodiment)

Figure 1:
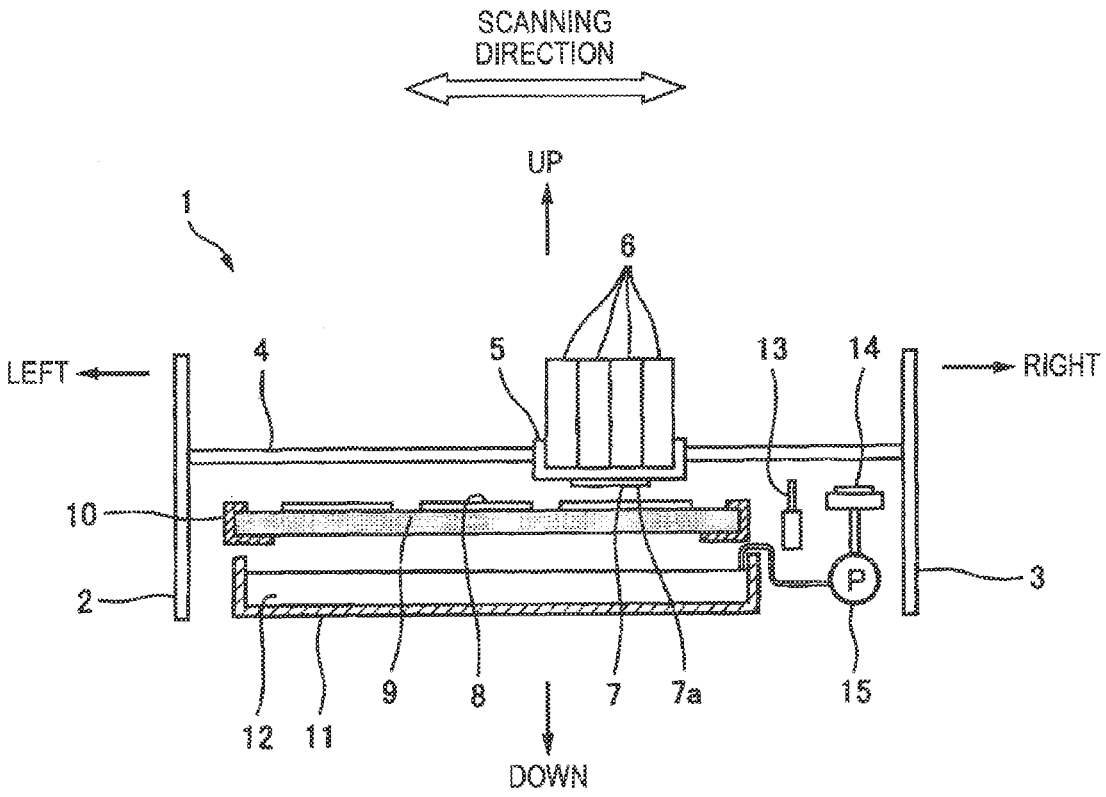
FIG. 1 is a front view of an inkjet printer according to a first exemplary embodiment of the present invention.

FIG. 1 is a front view of an inkjet printer 1 according to a first exemplary embodiment of the present invention. As shown in FIG. 1, the inkjet printer 1 includes a guide shaft 4 supported on left and right frames 2 and 3 and extending in the left and right direction. The guide shaft 4 supports a carriage 5 so as to be slidable in the left and right direction (scanning direction). The carriage 5 is joined to a timing belt (not shown) that reciprocates in the left and right direction. Then, the carriage 5 performs reciprocating scanning in the left and right direction as the timing belt is reciprocated by a motor (not shown).

On the upper side of the carriage 5, four ink cartridges 6 corresponding to four color inks (black, cyan, magenta, and yellow), respectively, are detachably mounted. On the lower side of the carriage 5, an inkjet head 7 is attached. The inkjet head 7 includes a nozzle face 7*a* formed with nozzles to eject ink. At a lower face thereof. That is, ink is ejected from the nozzles of the inkjet head 7 toward the surface of a recording medium 17 (see FIG. 2) of a sheet or the like being conveyed in the front and rear direction (conveying direction) orthogonal to the scanning direction below the inkjet head 7.

Below the inkjet head 7, a platen 8 extends in the scanning direction and supports the recording medium 17 from the back surface side at a print area. Around the platen 8, a rectangular parallelepiped-shaped ink absorber 9 is provided. The ink absorber 9 is held at a predetermined position by a frame-like absorber mounting member 10 that holds the periphery of the ink absorber 9. Below the ink absorber 9, a waste ink tank 11 is provided, which is opened at upper face thereof. The waste ink tank 11 has such a size as to include the ink absorber 9 as a whole in a plan view. The waste ink tank 11 houses a waste ink absorbing member 12 formed of a porous member.

In a maintenance region where no printing is performed, a wiper blade 13 and a suction cap device 14 are provided. The wiper blade 13 is formed of an elastic plate of rubber and the like, and is configured to be able to wipe the nozzle face 7*a* of the lower face of the inkjet head 7 when the carriage 5 is moved toward the suction cap device 14. The suction cap device 14 is raised by a driving unit (not shown) so that the nozzle face 7*a* of the inkjet head 7 can be sealed when the inkjet head 7 is moved right above the suction cap device 14. Below the suction cap device 14, a suction pump 15 is arranged, which applies a negative pressure to a sealing space of the suction cap device 14. The suction cap device 14 functions not only as a cap to prevent the nozzles of the inkjet head 7 from drying during suspension of printing but also to perform a purge operation. In the purge operation, the negative pressure from the suction pump 15 acts on the nozzles of the inkjet head 7 to cause a negative-pressure suction of dry ink, foreign matter, and the like from the nozzles. Thus, the ink ejected to the inside of the suction cap device 14 is sent by the suction pump 15 to the waste ink tank 11, and absorbed by the waste ink absorbing member 12 housed in the waste ink tank 11.

Figure 2:
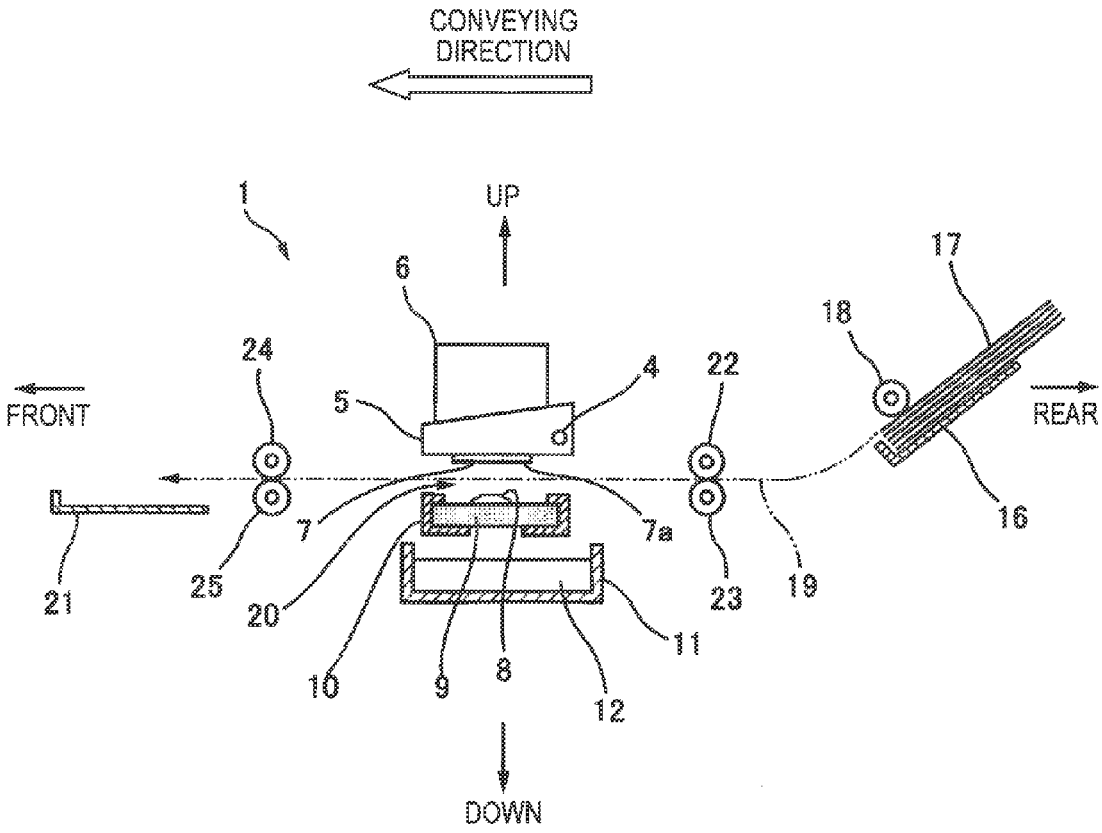
FIG. 2 is a side view of the inkjet printer shown in FIG. 1.

FIG. 2 is a side view of the inkjet printer 1 shown in FIG. 1. As shown in FIG. 2, a sheet feeding tray 16 is provided in the rear part of the inkjet printer 1. At an opposed position to the sheet feeding tray 16, a feed drive roller 18 is provided. The feed drive roller 18 feeds the uppermost one of the recording media 17 of sheets stacked on a sheet feeding tray 16 to a conveying path 19. The conveying path 19 is directed to a sheet discharging tray 21 forward from the lower end of the sheet feeding tray 16 through a print area 20.

In the print area 20, the platen 8 is arranged below the inkjet head 7. On the back surface side (lower side) of the recording media 17 supported by the platen 8, the ink absorber 9 is provided so as to be opposed to the inkjet head 7. The ink absorber 9 is arranged around the platen 8 so as to have a larger area in a plan view than that of the platen 8.

At an upstream side of the inkjet head 7, a conveying roller 22 and a pinch roller 23 are provided. The conveying roller 22 and the pinch roller 23 pinch the recording medium 17 fed into the conveying path 19 and convey the recording medium 17 onto the platen 8. At a downstream side of the inkjet head 7, a discharge roller 24 and a pinch roller 25 are provided. The discharge roller 24 and the pinch roller 25 pinch the printed recording medium 17 and convey the printed recording medium 17 to the sheet discharging tray 21. The sheet feeding tray 16, the feed drive roller 18, the conveying roller 22, the pinch roller 23, the discharge roller 24, and the pinch roller 25 convey a plurality of types of recording media 17 of different sizes so that one side parallel to the conveying direction passes through a common reference position (see FIG. 3).

The inkjet head 7 includes a flow path unit (not shown) having a plurality of flow paths (not shown) to guide ink that flows in from the ink cartridges 6 to a plurality of nozzles (not shown) formed at the nozzle face 7*a* and a piezoelectric-driven actuator that selectively imparts an ejection pressure to the ink in the flow paths of the flow path unit toward the nozzle.

Figure 3:
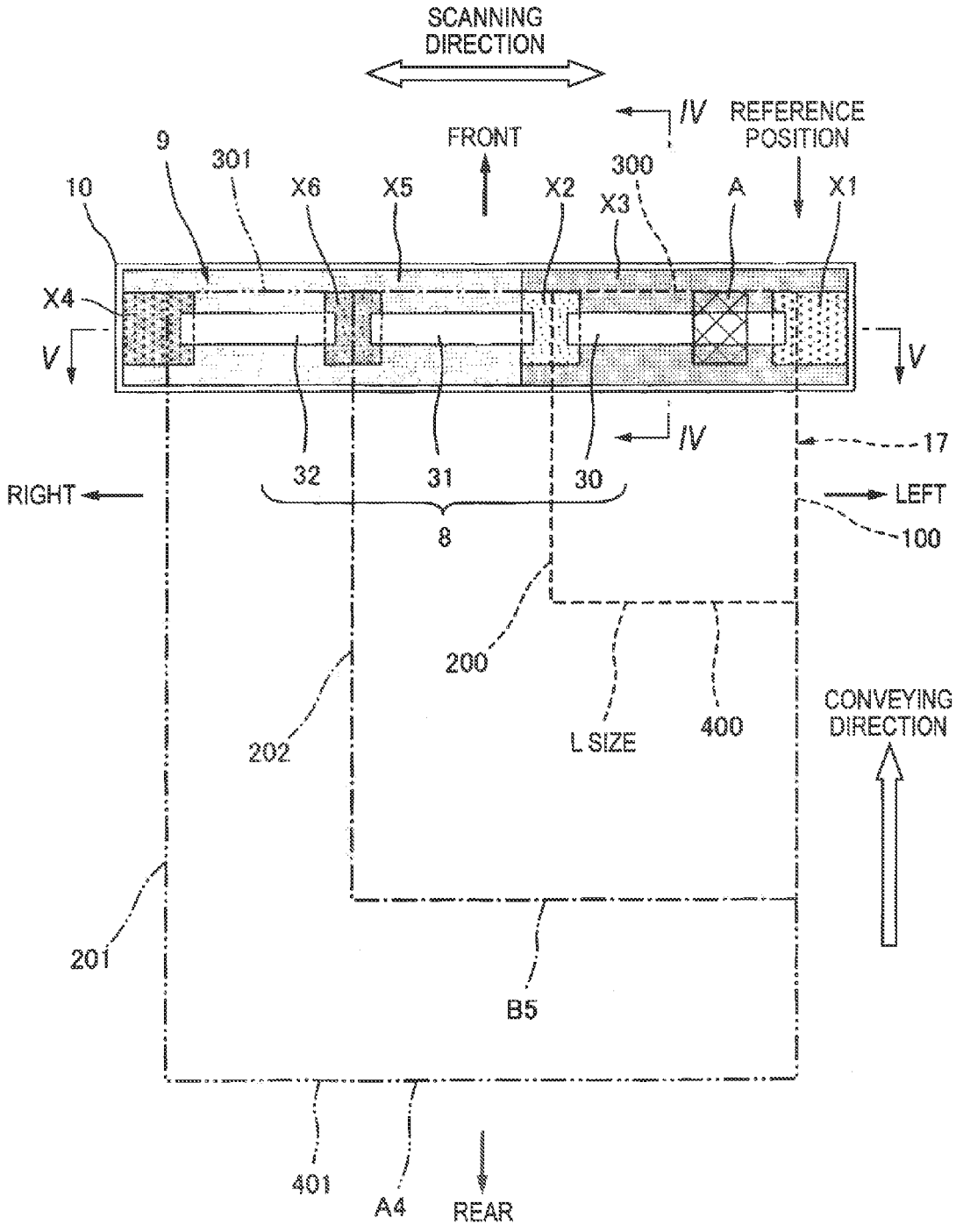
FIG. 3 is a front view showing an ink absorber of the inkjet printer shown in FIG. 1.
Figure 4:
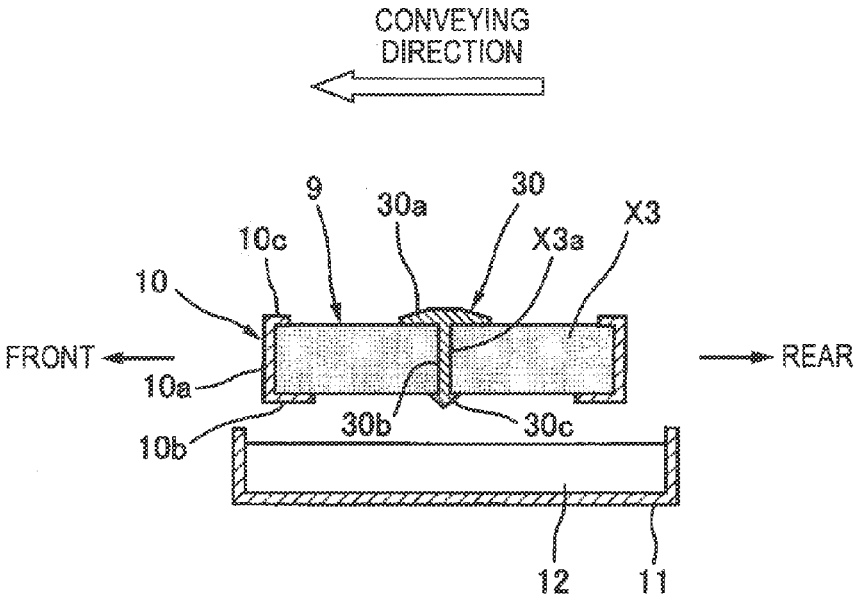
FIG. 4 is a sectional view along a line IV-IV of FIG. 3.
Figure 5:
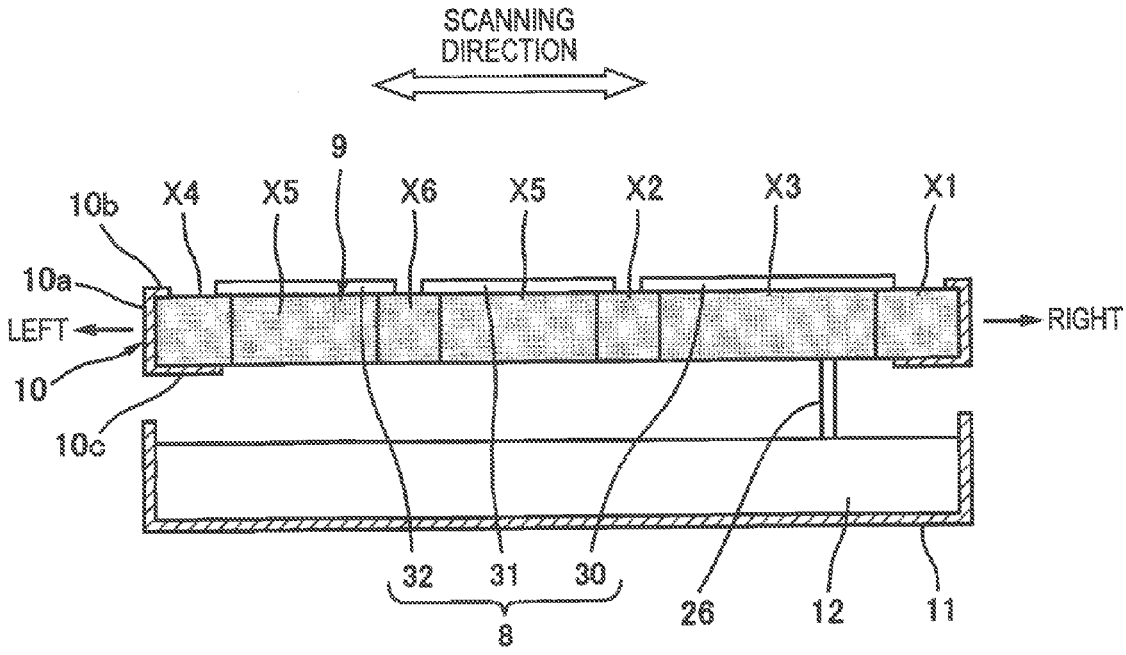
FIG. 5 is a sectional view along a line V-V of FIG. 3.

FIG. 3 is a front view showing the ink absorber 9 of the inkjet printer 1 shown in FIG. 1. FIG. 4 is a sectional view along a line IV-IV of FIG. 3. FIG. 5 is a sectional view along a line V-V of FIG. 3. As shown in FIG. 3 to FIG. 5, the ink absorber 9 is fitted in the frame-like absorber mounting member 10 opened at upper and lower faces thereof. The absorber mounting member 10 includes a sidewall portion 10*a* that abuts against the side face of the ink absorber 9, a support portion 10*b* that protrudes inward from the lower end of the sidewall portion 10*a*, and a retainer portion 10*c* that slightly protrudes inward from the upper end of the sidewall portion 10*a*.

The ink absorber 9 includes six porous members X1 to X6 (for example, sponge, urethane, a nonwoven fabric, and the like), and these porous members X1 to X6 contact each other so that the ink is flowable from one to another. That is, as a result of positioning by being fitted in the absorber mounting member 10 respectively, the six porous members X1 to X6 are arranged in contact with each other without using an adhesive and the like. It is noted that, for the porous members X1 to X6, their respective contact faces may be partially adhered in advance to an extent that does not hinder a mutual flow of the ink, or may be fixed to each other in advance by a fastener such as a stapler.

The platen 8 includes three platen elements 30 to 32 arranged at intervals in the scanning direction. Since the platen elements 30 to 32 have almost the same configuration as each other, description will be given of the platen element 30 as a representative.

As shown in FIG. 4, the platen element 30 includes a recording medium supporting portion 30*a* that abuts against the upper face of the porous member X3, a shaft portion 30*b* extending downward from the recording medium supporting portion 30*a*, and a catching portion 30*c* formed in an arrow-head shape at the lower end of the shaft portion 30*b*. At a necessary position of the porous member X3, an attaching hole X3*a* that penetrates in the up and down direction is formed. By inserting the shaft portion 30*b* of the platen element 30 from the catching portion 30*c* through the attaching hole X3*a* from top to bottom, the catching portion 30*c* is held at the lower face of the porous member X3, whereby the platen element 30 is fixed.

As shown in FIG. 3, the ink absorber 9 includes the six porous members X1 to X6 arranged in a plan view observed from above. The six porous members X1 to X6 are different in absorption rate from one another. That is, in the ink absorber 9, a plurality of regions X1 to X6 different in absorption rate from one another are provided in a plan view observed from a normal direction of the recording medium 17 in the print area 20, that is, an ink ejecting direction of the inkjet head 7. In the inkjet printer 1, recording media 17 of different sizes (for example, A4, B5, L size, etc.) are usable, and as described above, these recording media 17 of different sizes are conveyed while left sides (right-hand sides in FIG. 3) thereof all pass through a common reference position. That is, one side of the recording medium 17 of each size that passes through the reference position serves as a reference side 100 at the time of conveyance. It is noted that the region denoted by a sign A in FIG. 3 is an ink ejecting region by the inkjet head 7 (see FIG. 1 and FIG. 2), and the ink ejecting region A is reciprocated left and right as a result of the inkjet head 7 being reciprocated left and right.

The ink absorber 9 includes the porous member X1 having the highest absorption rate among the six porous members X1 to X6 in a region corresponding to a left scanning end of the ink discharging region A and corresponding to the reference side 100 of the recording medium 17. Also, the ink absorber 9 includes the porous member X2 having the second highest absorption rate among the six porous members X1 to X6 in a region corresponding to a right scanning end of the ink discharging region A in L-size printing and corresponding to an opposed side 200 (right side) parallel to the reference side 100 of the recording medium 17 of L size. The ink absorber 9 includes the porous member X3 having the third highest absorption rate among the six porous members X1 to X6 in a region corresponding to a front end and a rear end of the ink discharging region A in L-size printing and corresponding to a front side 300 and a rear side 400 orthogonal to the reference side 100 of the recording medium 17 of L size.

Further, the ink absorber 9 includes the porous member X4 having the fourth highest absorption rate among the six porous members X1 to X6 in a region corresponding to a right scanning end of the ink discharging region A in A4 printing and corresponding to an opposed side 201 (right side) parallel to the reference side 100 of the recording medium 17 of A4. Moreover, the ink absorber 9 includes the porous member X5 having the fifth highest absorption rate among the six porous members X1 to X6 in a region corresponding to a front end and a rear end of the ink discharging region A in A4 printing and corresponding to a front side 301 and a rear side 401 orthogonal to the reference side 100 of the recording medium 17 of A4 (excluding the region corresponding to the front side 300 and the rear side 400 of L size). Moreover, the ink absorber 9 includes the porous member X6 having the sixth highest absorption rate among the six porous members X1 to X6 in a region corresponding to a right scanning end of the ink discharging region A in B5 printing and corresponding to an opposed side 202 (right side) parallel to the reference side 100 of the recording medium 17 of B5.

These six porous members X1 to X6 are made of the same material (for example, sponge, urethane, a nonwoven fabric, etc.), and differentiated in absorption rate from one another by differentiating opening ratios in a state mounted on the absorber mounting member 10 from one another. For example, the porous members X1 to X6 have a relationship of opening ratios in an uncompressed state of X1>X2>X3>X4>X5>X6, and these are respectively mounted on the absorber mounting member 10 in similar compressed states. It is noted that the opening rations means a ratio of the pore volume per unit volume of the ink absorber. Alternatively, the porous members X1 to X6 may have opening ratios in an uncompressed state identical to each other and a relationship of respective compressibilities when being mounted on the absorber mounting member 10 becomes X6>X5>X4>X3>X2>X1 so that the opening ratios in a mounted state of the porous members X1 to X6 result in a relationship of X1>X2>X3>X4>X5>X6. Further, a single uniform porous member having uniform absorption rate (opening ratio) may be employed. In this case, the shape of the porous member is adjusted so that compressibilities of respective regions of the porous member become different to obtain an absorption rate distribution in the mounted state, similar to that obtained by the six porous members X1 to X6. In this case, the absorption rate (opening ration) in the mounted state varies continuously.

The platen 8 includes the three divided platen elements 30 to 32, which do not exist at positions corresponding to the reference side 100 and the opposed sides 200 to 202 of the recording media 17 of the respective sizes (A4, B5, and L size) and do not exist at positions corresponding to the front end and rear end of the ink discharging region A. For example, the platen element 30 extends in the left and right direction in a region between the front end and rear end of the ink discharging region A and between the reference side 100 and the opposed side 200 in a plan view. The platen element 31 extends in the left and right direction in a region between the front end and rear end of the ink discharging region A and between the opposed side 200 and the opposed side 202. The platen element 32 extends in the left and right direction in a region between the front end and rear end of the ink discharging region A and between the opposed side 202 and the opposed side 201.

As shown in FIG. 5, the ink absorber 9 is connected to the waste ink tank 11 via an ink guide portion 26. Specifically, the ink guide portion 26 is an ink guide tube, one end of which is connected to a porous member (for example, X3) other than the porous member X1 having the highest absorption rate, and the other end of which is connected to the waste ink absorbing member 12 in the waste ink tank 11.

Next, description will be given of operations of borderless printing by the inkjet printer 1.

In the inkjet printer 1, the carriage 5 including the inkjet head 7 reciprocates along the guide shaft 4 extending in the scanning direction, while the recording medium 17 of, for example, L size is conveyed between the inkjet head 7 and the platen 8 in the conveying direction orthogonal to the scanning direction described above. When the front side 300 of the recording medium 17 is conveyed to a position below the inkjet head 7, ink is ejected from the inkjet head 7 onto an end portion of the front side 300. That is, the inkjet head 7 ejects ink drops toward the surface of the recording medium 17 while reciprocating in the scanning direction along the guide shaft 4, whereby printing is started. In the borderless printing, for performing printing without leaving a margin in the end portion of the front side 300 of the recording medium 17, ink drops are also ejected to the front side (outside) of the end of the front side 300 of the recording medium 17. The ink drops ejected to the front side of the recording medium 17 are directly deposited on the porous member X3 of the ink absorber 9 provided around the platen 8 and penetrate the inside.

When printing of the end of the front side 300 of the recording medium 17 has ended, the recording medium 17 is conveyed in the conveying direction, and printing of a center portion of the recording medium 17 is performed. In printing of the center portion, for performing printing without leaving a margin in end portion of the left and right sides 100 and 200 of the recording medium 17, ink drops are also ejected to the left side (outside) of the end of the left side 100 and the right side (outside) of the end of the right side 200 of the recording medium 17. The ink drops ejected to the left and right outsides of the recording medium 17 are directly deposited on the porous members X1 and X2 of the ink absorber 9 provided around the platen 8 and penetrate the inside.

Furthermore, when printing of the center portion of the recording medium 17 has ended, the recording medium 17 is conveyed in the conveying direction, and printing of an end portion of the rear side 400 of the recording medium 17 is performed. In printing of the end portion of the rear side 400 as well, for performing printing without leaving a margin in the edge part of the rear side 400 of the recording medium 17, ink drops are also ejected to the rear side (outside) of the end of the rear side 400 of the recording medium 17. The ink drops ejected to the rear side of the recording medium 17 are directly deposited on the porous member X3 of the ink absorber 9 provided around the platen 8 and penetrate the inside.

The porous members X1 to X6 that compose the ink absorber 9 contact each other in a manner making ink flowable to each other, and thus the ink absorbed in the porous member (for example, X1, X2) having a low ink retaining force despite a high ink absorption rate flows, due to capillarity, to an adjacent other porous member (for example, X3, X5) having a high ink retaining force, and a large ink absorbing capacity of the ink absorber 9 as a whole is secured. Then, when the ink absorber 9 has absorbed a large amount of ink, the ink is to be guided, by self-weight and capillarity, to the waste ink tank 11 via the ink guide portion 26.

According to the configuration described above, increasing the absorption rate, of the ink absorber 9, in a region (for example, the porous members X1 and X2, and the like) where the amount of ink landing is expected to be large and reducing the absorption rate in a region (for example, the porous members X5 and X6, etc.) where the amount of ink landing is expected to be small allows improving ink absorbing ability, while ink retaining ability of the ink absorber 9 as a whole is maintained as much as possible.

Furthermore, one side of the recording medium 17 is conveyed to always passes through the reference position even when the recording medium 17 to be printed is different in size (for example, A4, B5, L size), and thus in a region of the ink absorber 9 corresponding to the reference side 100, the landing amount of ink spread beyond the end portion of the recording medium 17 is largest. Accordingly, by setting the porous member X1 provided in the region of the ink absorber 9 corresponding to the reference side 100 to the highest absorption rate, the ink can be efficiently absorbed.

In a region corresponding to the front side and rear side of the recording medium 17 in borderless printing, that is, a region (for example, the porous member X3) corresponding to the front side and rear side of the ink discharging region A, ink lands on the ink absorber 9 only when the ink is ejected along the front side 300 and the rear side 400 of the recording medium 17. In other words, during printing of a region between the front side 300 and the rear side 400 in the recording medium 17, a region corresponding to the front side and rear side of the ink discharging region A in the ink absorber 9 is covered with the recording medium 17 and no ink lands. On the other hand, in a region of the ink absorber 9 corresponding to the opposed side 200, ink spread beyond the end portion can land throughout printing from the front side 300 to the rear side 400 of the recording medium 17. Accordingly, by making the absorption rate in the porous member X2 of a region corresponding to the opposed side 200 parallel to the reference side 100 of the recording medium 17 higher than the absorption rate in the porous member X3 of a region corresponding to the front side 300 and the rear side 400 of the recording medium 17, the ink can be more efficiently absorbed while ink retaining ability of the ink absorber 9 is maintained.

Furthermore, the absorption rate of the porous region X4 of a region corresponding to the opposed side 201 of the recording medium 17 of a size (for example, A4) that is frequently used is set high and the absorption rate of the porous region X6 of a region corresponding to the opposed side 202 of the recording medium 17 of a size (for example, B5) that is less frequently used is set low, the ink can be more efficiently absorbed while ink retaining ability of the ink absorber 9 is maintained.

Moreover, since the ink guide portion 26 is connected, among the plurality of porous members X1 to X6 of the ink absorber 9, to a porous member (for example, X3) other than the porous member X1 having the highest absorption rate, that is, the porous member having a high retaining ability, ink is retained in the ink absorber 9 as well as the waste ink absorbing member 12.

(Second Exemplary Embodiment)

Figure 6:
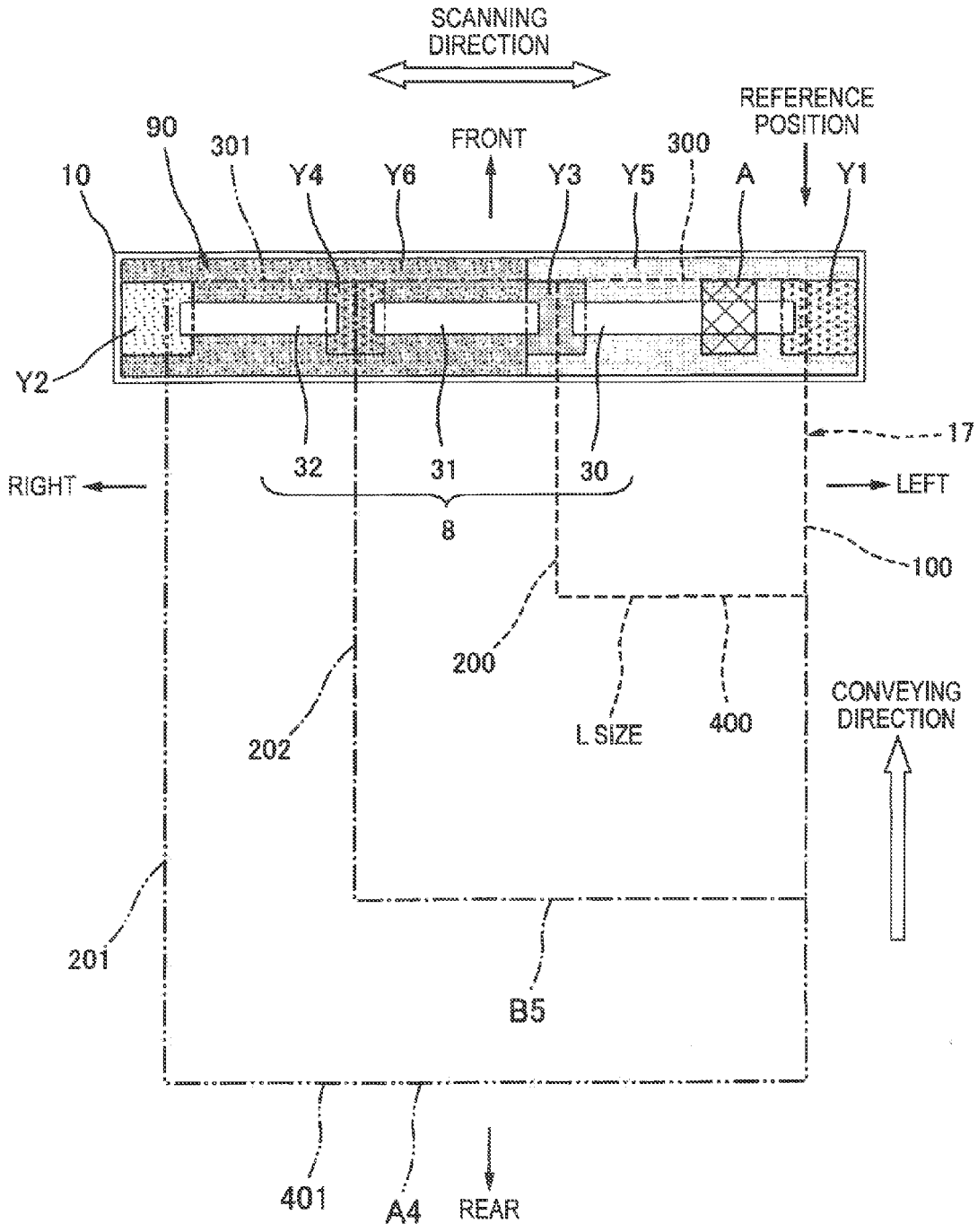
FIG. 6 is a plan view showing an ink absorber of an inkjet printer according to a second exemplary embodiment of the present invention.

FIG. 6 is a plan view showing an ink absorber 90 of an inkjet printer according to a second exemplary embodiment of the present invention. In the present exemplary embodiment, the absorption rate arrangement of porous members Y1 to Y6 of the ink absorber 90 is changed as compared with the first exemplary embodiment. In such a case where a large amount of text printing to the recording medium 17 is performed, in order to prevent the nozzles from drying due to a current of air caused by a reciprocation of the inkjet head 7 (see FIG. 1) itself, a flushing operation of temporarily evacuating the inkjet head 7 to a position near the left and right sides of the recording medium 17 outside the left and right sides of the recording medium 17 and ejecting ink from the nozzles is sometimes performed in the middle of printing.

In the case of an inkjet printer thus configured, a large amount of ink is to directly land, in the ink absorber 90, at a position corresponding to the left and right sides of the recording medium 17. Consequently, in the present exemplary embodiment, as shown in FIG. 6, the porous member Y1 having the highest absorption rate is arranged in a region corresponding to a left scanning end of the ink ejecting region A and corresponding to the reference side 100 of the recording medium 17, and the porous member Y2 having the second highest absorption rate is arranged in a region corresponding to a right scanning end of the ink ejecting region A and corresponding to the opposed side 201 of the recording medium 17 of A4 size that is frequently used. In addition, the porous member Y3, Y4 having the third or fourth highest absorption rate is arranged in a region corresponding to the right scanning end of the ink ejecting region A and corresponding to the opposed side 200, 202 of the recording medium 17 of L size or B5 size. Furthermore, in a region corresponding to the front end and rear end of the ink ejecting region A in L-size printing and corresponding to the front side 300 and the rear side 400 of the recording medium 17 of L size, the porous member Y5 having the fifth highest absorption rate is arranged. Moreover, in a region corresponding to the front end and rear end of the ink ejecting region A in A4 printing and corresponding to the front side 301 and the rear side 401 of the recording medium 17 of A4 size, the porous member Y6 having the sixth highest absorption rate is arranged.

By the above configuration, even when a flushing operation of temporarily evacuating the inkjet head 7 to an outside position of the left and right sides of the recording medium 17 and discharging ink from the nozzles is performed in the middle of printing, the ejected ink speedily penetrates into the porous members Y1 to Y4 of the ink absorber 90, and the ink is retained in the ink absorber 90 as a whole. Also, parts in common with the first exemplary embodiment are denoted by identical reference numerals, and description thereof is omitted.

As in the above, an inkjet printer according to the present invention has an excellent effect of improving ink absorbing ability while maintaining ink retaining ability of an ink absorber as much as possible, and the present invention may be advantageous when being widely applied to an inkjet printer capable of enjoying the effect of the present invention.

While the present invention has been shown and described with reference to certain exemplary embodiments thereof, it will be understood by those skilled in the art that various changes in form and details may be made therein without departing from the spirit and scope of the invention as defined by the appended claims.

In the above exemplary embodiments, an image is formed while the inkjet head 7 reciprocates in the scanning direction. However, the inventive concept of the present invention is not limited thereto. For example, a line-type inkjet head may be used, which extends over a print area and forms an image without moving.

What is claimed is:

1. An inkjet printer comprising:

an inkjet head which ejects ink toward a surface of a recording medium;

a platen provided opposed to the inkjet head to support the recording medium from an opposite side of the inkjet head;

an absorber provided opposed to the inkjet head at the same side as the platen with respect to the recording medium supported by the platen; and a conveying unit which conveys a plurality of recording media of different sizes in a conveying direction;

wherein the absorber includes a plurality of regions which lie in a same plane parallel to a surface of the recording medium supported by the platen, and are different in absorption rate from one another in a plan view observed from a normal direction of the recording medium supported by the platen;

wherein the conveying unit conveys the plurality of recording media so that a reference edge of each of the different sizes of recording media parallel to the conveying direction passes through a common reference position;

wherein the absorber has the highest absorption rate in a first region, of the plurality of regions, corresponding to a portion of the absorber above which the reference edge of the recording medium is conveyed;

wherein the absorber has a higher absorption rate in a second region, of the plurality of regions, corresponding to a portion of the absorber above which an opposed edge of one size of recording media, parallel and opposite to the reference edge of the recording medium, is conveyed, than an absorption rate in a third region, of the plurality of regions, corresponding to a portion of the absorber above which a front edge and a rear edge of the recording medium are conveyed, each of the front and rear edges extending orthogonal to the conveying direction and spanning a distance between the reference edge and the opposed edge;

wherein the second region of the absorber includes a plurality of second regions corresponding to portions of the absorber above which opposed edges of the different sizes of recording media, which are parallel and opposite to the reference edges of the respective sizes of recording media, are conveyed; and wherein the plurality of second regions are different in absorption rate from one another.

2. The inkjet printer according to claim 1, further comprising:

an absorber mounting portion which mounts the absorber therein;

wherein the absorber is formed of a plurality of porous members; and wherein the plurality of porous members are configured to be different in opening ratio from one another in a state mounted on the absorber mounting portion.

3. The inkjet printer according to claim 2;

wherein the plurality of porous members contact each other so that ink is flowable from one to another of the porous members.

4. The inkjet printer according to claim 1, further comprising:

an absorber mounting portion which mounts the absorber therein;

wherein the absorber is formed of a single uniform porous member; and wherein the absorber has a shape so that the porous member has the plurality regions different in absorption rate from one another in a state mounted on the absorber mounting portion.

5. The inkjet printer according to claim 1, further comprising:

a waste tank; and an ink guide portion which guides ink in the absorber to the waste tank;

wherein the ink guide portion is connected to a region other than a region having the highest absorption rate among the plurality of regions of the absorber.

6. The inkjet printer according to claim 1;

wherein the inkjet head ejects ink at a position in which the ink reaches outside of the recording medium supported by the platen.

7. An inkjet printer comprising:

a platen which supports a recording medium;

an inkjet head which ejects ink on the recording medium supported by the platen; and an absorber which is provided at lower position from the inkjet head with respect to a top of the platen and which absorbs the ink ejected from the inkjet head, the absorber including a plurality of regions which lie in a same plane parallel to a surface of the recording medium supported by the platen, and have different ink absorption capability in a plan view observed from an ink ejecting direction of the inkjet head;

a conveying unit which conveys the recording medium in a conveying direction;

wherein the absorber include a first region, of the plurality of regions, at one end thereof, the first region having a highest ink absorption capability in the absorber;

wherein one edge of the recording medium parallel to the conveying direction passes above the first region of the absorber when conveyed by the conveying unit;

wherein the absorber includes a plurality of second regions, of the plurality of regions, provided at specific intervals from the first region;

wherein the second regions each have a higher ink absorption capability than that of another region, of the plurality of regions, of the absorber other than the first region; and wherein the second regions have ink absorption capability different from one another.

8. The inkjet printer according to claim 7;

wherein the ink absorption capability in the absorber varies continuously.

9. The inkjet printer according to claim 7;

wherein the ink absorption capability of the absorber increases as ink retaining capability of the absorber decreases.

10. The inkjet printer according to claim 1;

wherein the platen and the absorber contact with each other.

11. The inkjet printer according to claim 7;

wherein the platen and the absorber contact with each other.

* * * * *